United States Patent [19]

Paige

[11] 4,182,477

[45] Jan. 8, 1980

[54] COLLAPSIBLE CARTON

[75] Inventor: Richard E. Paige, New York, N.Y.

[73] Assignee: The Paige Company Containers, Inc., New York, N.Y.

[21] Appl. No.: 965,356

[22] Filed: Nov. 30, 1978

[51] Int. Cl.[2] ..... B65D 5/02; B65D 5/36

[52] U.S. Cl. ..... 229/37 R; 229/41 B

[58] Field of Search ..... 229/37 R, 41 B

[56] References Cited

U.S. PATENT DOCUMENTS

| | | | |
|---|---|---|---|
| 2,843,308 | 7/1958 | Paige | 229/37 R |
| 3,278,108 | 10/1966 | Paige | 229/37 R |
| 3,310,221 | 3/1967 | Duncan | 229/37 R |
| 3,430,840 | 3/1969 | Paige | 229/41 B X |

*Primary Examiner*—Davis T. Moorhead

*Attorney, Agent, or Firm*—Alan H. Levine

[57] ABSTRACT

A collapsible carton comprising inner and outer snugly nested tubular shells. Each shell includes a series of side wall panels hingedly connected together along their side edges. The shells are telescopically adjustable into and out of a set-up relationship in which the overlying side wall panels define a set of double-walled carton sides. A plurality of foldable strips interconnect adjacent bottom edges of only some of the overlying side wall panels, the strips extending transverse to the side wall panels when the carton is set up so as to define a floor support. A floor panel is hinged to the bottom edge of a side wall panel having no foldable strip connected to it, the floor panel overlying the floor support and defining a smooth floor of the carton.

4 Claims, 6 Drawing Figures

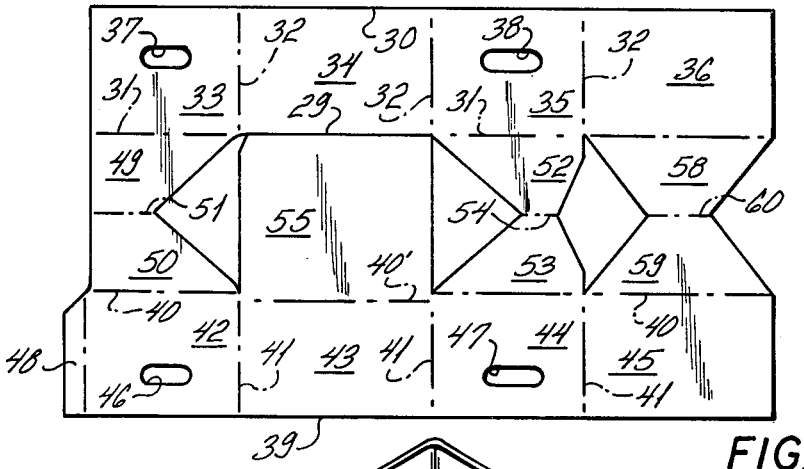
FIG. 4
FIG. 2
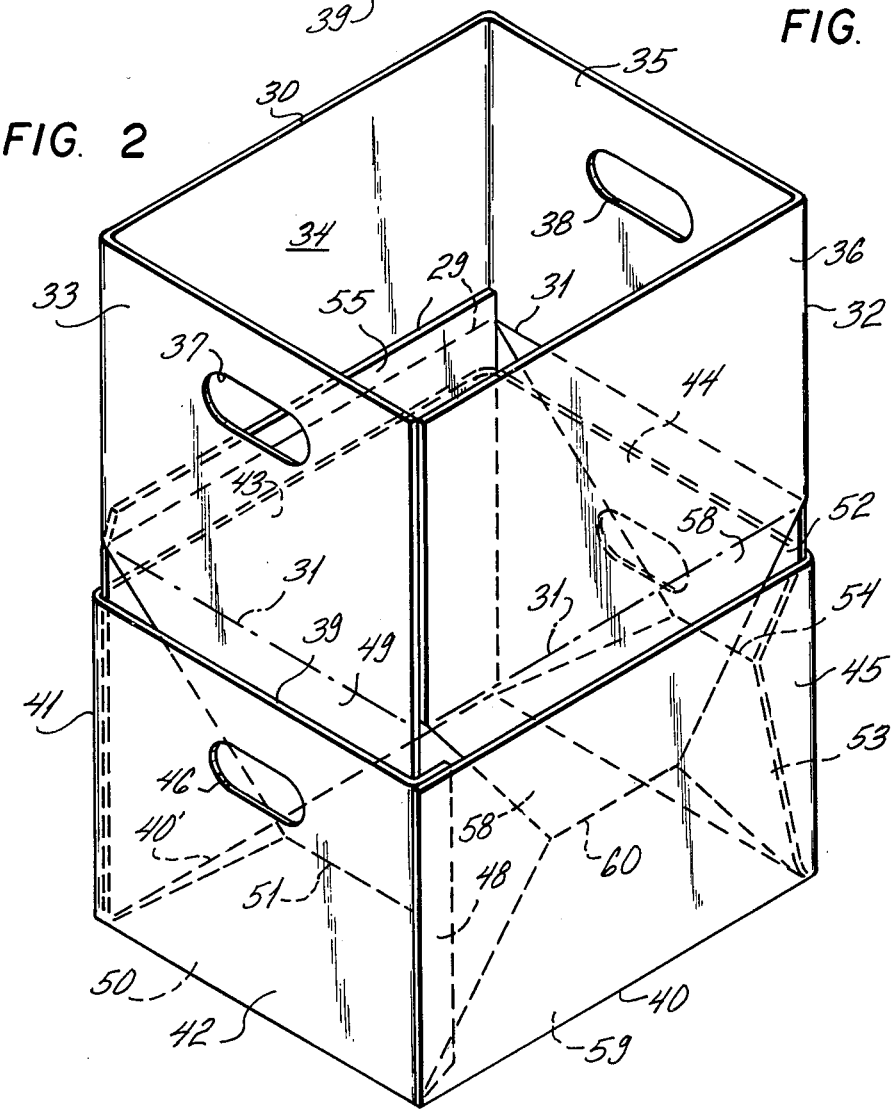

COLLAPSIBLE CARTON

This invention relates to collapsible cartons of the type which are usually formed of corrugated cardboard, and particularly to such cartons having double-walled sides. More specifically, the invention involves an improvement in cartons of the type shown and described in U.S. Pat. Nos. 2,577,588 and 2,843,308.

In these cartons, inner and outer tubular shells are snugly nested, the shells being telescopically extended when the carton is collapsed flat for shipping and storage, and the inner shell being moved telescopically into the outer shell, when the carton is set up for use, to define a series of double-walled carton sides. A foldable strip is hinged to the bottom edges of the overlying walls of each carton side, these strips being extended generally in the plane of the flattened shells when the carton is collapsed flat. When the carton is set up, the strips fold and assume a position transverse to the carton sides to define a multiple layer bottom of the carton.

A problem presented by this known carton construction is that the carton bottom is not smooth. The foldable strips overlap each other, thereby producing a non-planar, stepped configuration at various locations around the carton bottom. Furthermore, an inherent weakness is present along a line where two of the folded strips meet in a butted, not overlapped, relationship.

It is an object of the present invention to provide a collapsible carton of the type described having a smooth bottom.

It is another object of the present invention to provide such a carton with a continuous bottom having no points of weakness.

It is a further object of the invention to provide a carton of the type described having a one piece floor which nevertheless sets up and collapses with the same ease as the cartons known heretofore.

Additional objects and advantages of the invention will be apparent from the following description in which reference is made to the accompanying drawings.

In the drawings:

FIG. 2 is a perspective view of the carton in partially set-up condition;

FIG. 4 is a pattern view of a single blank of which the carton may be formed;

Figure 1:
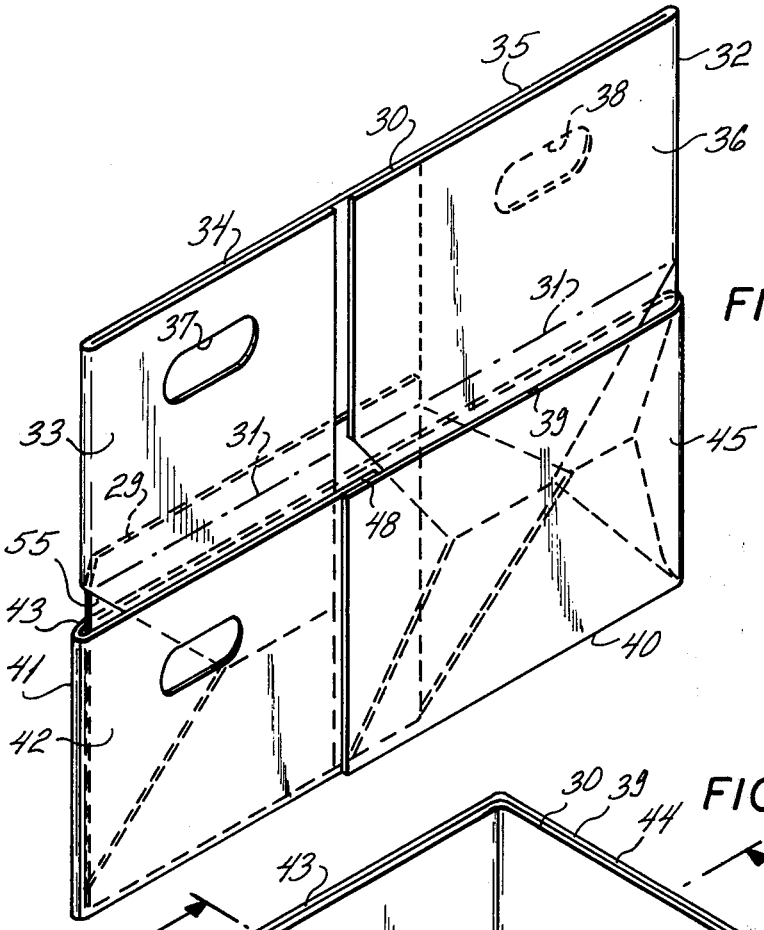
FIG. 1 is a perspective view of a carton in accordance with this invention in flattened or collapsed condition.
Figure 3:
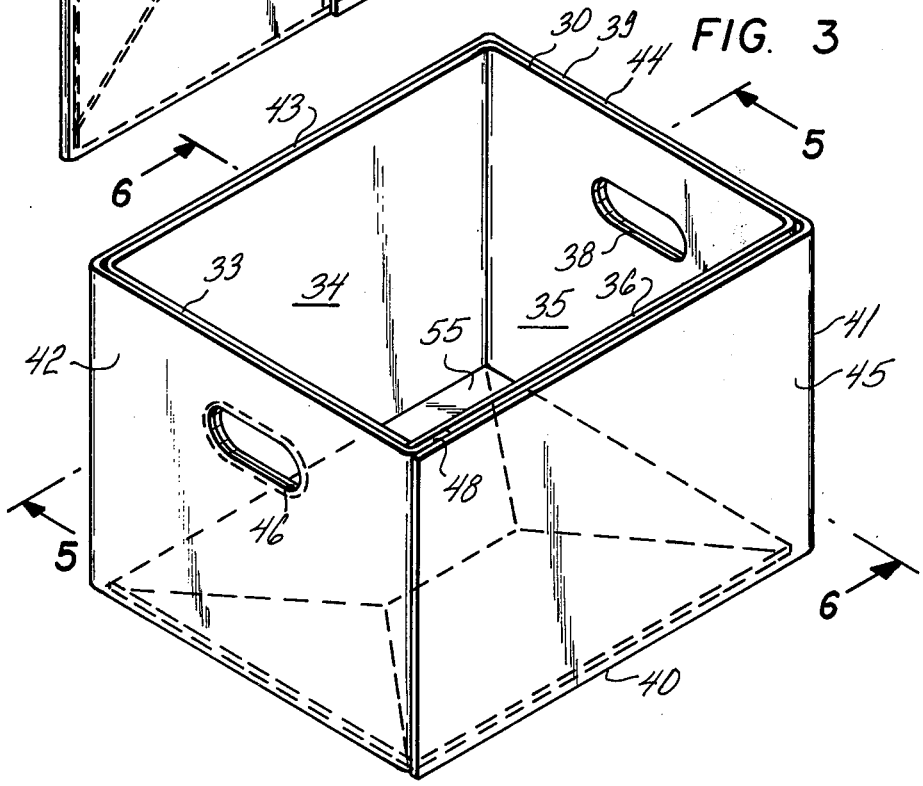
FIG. 3 is a perspective view of the carton in completely set-up condition.

Referring first to FIG. 4, a substantially rectangular carton of the present improved character may be formed of a single substantially rectangular blank of foldable sheet material which is scored and cut as indicated. Parallel to the edge 30 is a score line 31 interrupted by a slit 29. This line, in conjunction with transverse score lines 32, defines a series of four rectangular panels 33, 34, 35 and 36 which are ultimately in hinged relationship along the lines 32 to define the four sides of a tubular shell of substantially rectangular cross section when set up. It will be observed that the panels 33 and 35 are substantially the same in size, and the panels 34 and 36 are substantially the same in size. For a purpose hereinafter to be described, the panel 33 is provided with the opening 37, and the panel 35 is provided with the similar opening 38.

The panels 33–36 are adapted ultimately to form the four sides of an inner tubular shell adapted to nest within an outer shell hereinafter to be referred to.

Parallel to the opposite edge 39 of the blank is a score line 40, having one offset portion 40', which, in conjunction with transverse score lines 41, each of which aligns with one of the lines 32, defines a second series of substantially rectangular panels 42, 43, 44 and 45. The panels 42 and 44 are substantially equal in size, and the panels 43 and 45 are substantially equal in size. The panel 42 is provided with the opening 46, and the panel 44 is provided with the similar opening 47.

The panels 42–45 are adapted ultimately to form the four sides of the outer tubular shell hereinbefore mentioned.

Between the score lines 31 and 40, the blank is cut and scored to define a series of adjacent connecting strips ultimately adapted to serve as foldable sections which cooperate to form the carton floor support. One connecting strip consists of the sections 49 and 50 mutually hinged along the line 51. The sections 49 and 50 are trapezoidal in shape, the long base of the trapezoid 49 coinciding with the adjacent long edge of the panel 42. A similar set of sections 52 and 53 are formed between the panels 35 and 44, the sections 52 and 53 being mutually hinged along the line of fold 54. The connecting strip between the panels 36 and 45 consists of trapezoidal sections 58 and 59 mutually hinged at 60.

Between score line 40' and slit 29 is a generally rectangular panel 55 which defines the floor of the carton, the panel 55 being free on three sides and hinged to the remainder of the blank along line 40'.

After the blank has been scored and cut as indicated in FIG. 4 and as herein described, it is folded upon itself along the line 40, 40' and is then folded transversely along the lines 32 and 41 at each side until the attachment flap 48 (on the end of panel 42) is brought into overlapping engagement with the free edge of the panel 45. This flap is then secured to this free edge either by gluing, stapling, or otherwise, and the resultant structure assumes the flattened condition shown in FIG. 1. This completes the manufacturing procedure, which, it will be noted, is extremely simple and inexpensive. In the condition shown in FIG. 1, the device may be stacked with others, packaged, readily transported, or stored.

The process of setting up the device is illustrated most clearly in FIGS. 2, 3, 5, and 6. The first step is to open the device into the condition shown in FIG. 2, in which each shell assumes a substantially tubular configuration. The outer shell, as hereinbefore mentioned, consists of the panels 42–45, its lower edge being defined by the line 40, 40'. The inner shell consists of the panels 33–36, its lower edge being defined by the line 31. Connecting these lower edges are the scored foldable strips which, in FIGS. 1 and 2, lie substantially parallel to the respective panels which they connect.

Panel 55 is folded upwardly along line 40' so as to be in substantially face-to-face contact with panels 43 and 34 in FIGS. 1 and 2. Although the upper edge of panel 55 and the lower edge of panel 34 were defined by slit 29, the upper edge of panel 55 is located above the bottom edge of panel 34 because fold line 40' is offset from fold line 40. As a result, the upper edge of panel 55 cannot butt and become caught against the lower edge of panel 34, which might be a problem if fold line 40' were colinear with fold line 40.

Figure 5:
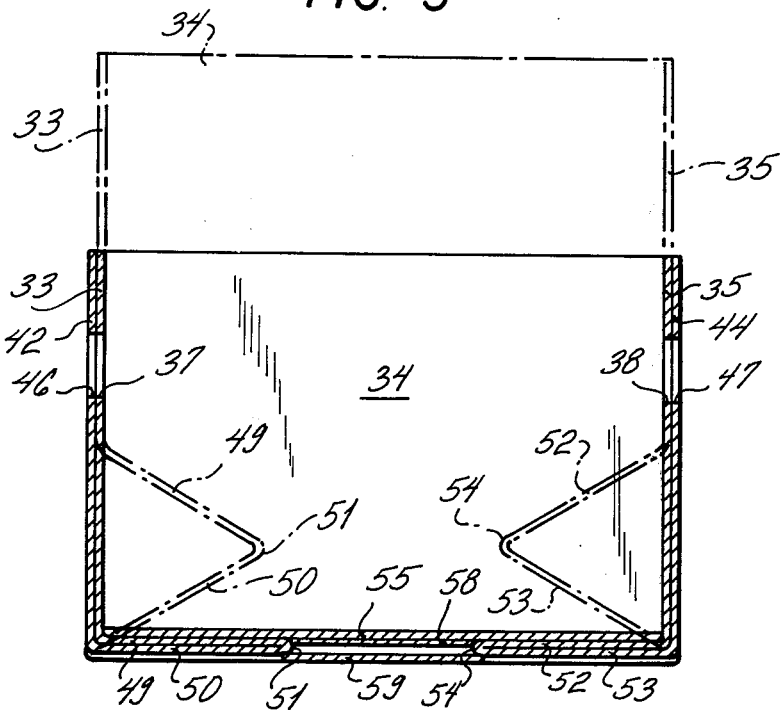
FIG. 5 is a vertical cross-sectional view taken along line 5—5 of FIG. 3.
Figure 6:
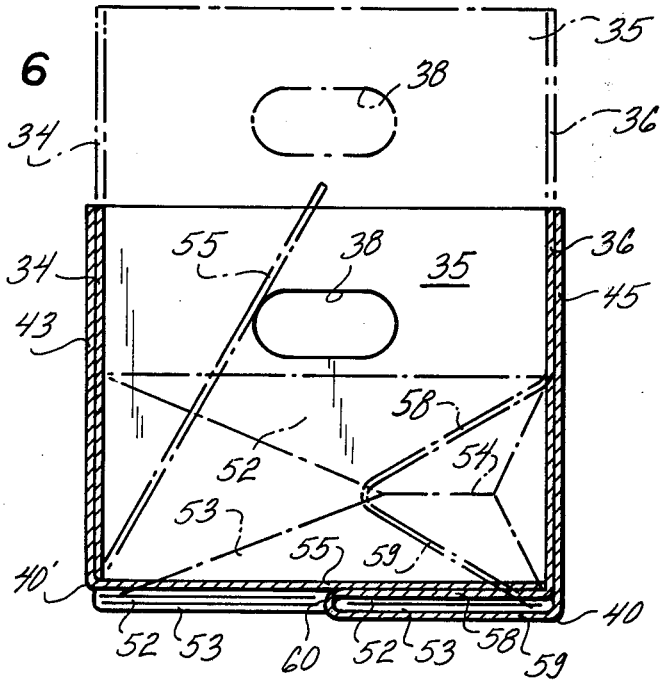
FIG. 6 is a vertical cross-sectional view taken along line 6—6 of FIG. 3.

The next and final step in setting up the structure is illustrated most clearly in FIGS. 5 and 6, and consists in pressing the inner shell into the outer shell, i.e., by adjusting the shells into telescopically contracted relation. During this movement, the connecting strips angle inwardly, i.e., each strip folds upon itself. During this folding adjustment, the sections 49–50 and 52–53 slide into positions between the folds of the trapezoidal sections 58 and 59. Ultimately, the three folded sections lie in the interengaged relationship shown most clearly in FIGS. 5 and 6. In this condition, these sections conjointly define a double-walled carton floor support.

Panel 55 is then folded down upon the folded strips, the combination of support by the folded strips and along hinge line 40' making the floor 55 very strong and capable of bearing great weight. Furthermore, the final floor within the carton is perfectly smooth. Also, because of the offset nature of hinge line 40' with respect to fold line 40, floor panel 55 is horizontal, and not angled as it would be if hinge line 40' were colinear with fold line 40.

Upon completion of the setting-up operation there will be a registry of the openings 37 and 46 in one of the side walls of the carton, and a corresponding registry of the openings 38 and 47 in the opposite side wall. Each pair of registering openings affords a convenient hand grip by means of which the carton may be conveniently grapsed for lifting it or transporting it from place to place.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A carton comprising inner and outer snugly nested tubular shells, each shell including a series of side wall panels hingedly connected together along their side edges, said shells being telescopically adjustable into and out of a set-up relationship in which the overlying side wall panels define a set of double-walled carton sides, a plurality of foldable strips interconnecting adjacent bottom edges of only some of said overlying side wall panels, said strips extending transverse to said side wall panels when said shells are telescoped into the set-up relationship so as to define a floor support, and a floor panel hinged to the bottom edge of a side wall panel havng no foldable strip connected to its, said floor panel overlying said floor support and defining a smooth floor of the carton.

2. A carton as defined in claim 1 wherein said floor panel is hinged to the bottom edge of an outer shell side wall panel.

3. A carton as defined in claim 1 wherein the dimensions of said floor panel in its own plane are about equal to the horizontal cross-sectional dimensions of said inner shell at its lower end.

4. A carton as defined in claim 1 wherein each of said foldable strips in hinged to the bottom edge of its respective side wall panel, and the line along which said floor panel is hinged to its respective side wall panel is spaced slightly above the hinge lines between said foldable strips and side wall panels.

* * * * *